US006639194B2

(12) United States Patent
Pascal et al.

(10) Patent No.: US 6,639,194 B2
(45) Date of Patent: Oct. 28, 2003

(54) METHOD FOR MANUFACTURING A MULTIPLE WALLED TUBE

(75) Inventors: Lamande Pascal, St. Cyr/Loire (FR); Pierini Vincenzo, Savignone (IT); Volvert Albert, Seraing (BE)

(73) Assignee: TI Group Automotive Systems Limited (GB)

( * ) Notice: Subject to any disclaimer, the term of this patent is extended or adjusted under 35 U.S.C. 154(b) by 47 days.

(21) Appl. No.: 09/923,818

(22) Filed: Aug. 7, 2001

(65) Prior Publication Data

US 2002/0092891 A1 Jul. 18, 2002

(30) Foreign Application Priority Data

Aug. 18, 2000 (EP) ..... 00307079

(51) Int. Cl.[7] ..... B23K 13/01; B23K 1/002; B23K 31/02

(52) U.S. Cl. ..... 219/609; 219/61; 219/129; 219/615; 228/17.5; 228/173.6

(58) Field of Search ..... 228/164, 173.1, 228/173.2, 173.4, 173.6, 173.7, 17, 17.5, 17.7; 219/607, 609, 612, 643, 644, 59.1, 60 R, 60.2, 61, 129, 615–617

(56) References Cited

U.S. PATENT DOCUMENTS

| | | | | | |
|---|---|---|---|---|---|
| 4,412,560 | A | | 11/1983 | Broodman | |
| 5,069,381 | A | * | 12/1991 | Gibbs et al. | 228/132 |
| 5,122,637 | A | * | 6/1992 | Bottorff et al. | 219/229 |
| 5,145,103 | A | * | 9/1992 | Johnson | 228/143 |
| 5,163,602 | A | * | 11/1992 | Usui | |
| 5,222,652 | A | * | 6/1993 | Gibbs et al. | 138/142 |
| 5,297,410 | A | * | 3/1994 | Goff | |
| 5,297,587 | A | * | 3/1994 | Johnson | 138/140 |
| 5,447,179 | A | * | 9/1995 | Gibbs et al. | 138/140 |
| 6,092,556 | A | | 7/2000 | Adkins | |
| 2002/0092891 | A1 | * | 7/2002 | Pascal et al. | |

FOREIGN PATENT DOCUMENTS

| | | | |
|---|---|---|---|
| DE | 20 61 560 | A | 6/1972 |
| EP | 0457169 | A2 * | 11/1991 |
| EP | 0546790 | A1 * | 6/1993 |
| EP | 1181993 | A1 * | 2/2002 |
| FR | 1 015 678 | A | 10/1952 |
| GB | 2 034 206 | A | 6/1980 |
| GB | 1 591 907 | A | 7/1981 |
| JP | 405245534 | A * | 9/1993 |
| JP | 02000130651 | A * | 5/2000 |

* cited by examiner

*Primary Examiner*—Tom Dunn
*Assistant Examiner*—Kiley Stoner
(74) *Attorney, Agent, or Firm*—Jenner & Block, LLC

(57) ABSTRACT

A method for manufacturing a multiple walled tube comprising a rolling of a plated metal strip through at least two complete revolutions to form a tube having at least a double wall which has a plated layer on the inside of the tube, said rolling being followed by a heating of the tube to cause the surface of the tube walls, which are in contact with one another, to be brazed and wherein said metal strip is plated on one side, the other side being formed by the steel of the metal strip and wherein said brazing is realised by brazing directly the plated side on the steel.

13 Claims, 4 Drawing Sheets

METHOD FOR MANUFACTURING A MULTIPLE WALLED TUBE

This invention is based on a foreign priority application, European Patent Application No. EP 00 307 079.4, filed on Aug. 18, 2000.

The invention relates to a method for manufacturing a multiple walled tube comprising a rolling of a plated metal strip through at least two complete revolutions to form a tube having at least a double wall which has a plated layer on the inside of the tube, said rolling being followed by a heating of the tube to cause the surface of the tube walls, which are in contact with one another, to be brazed.

Such a method is known from FR-1.015.678. According to the known method, a metal strip plated at both sides with copper is used. Once the metal strip is rolled, the tube is heated in order to braze the copper at the contact faces between the walls of the tube. Zinc or tin could be used for the brazing in order to reduce the melting point of the copper.

A drawback of the known method is that the metal strip is plated at both sides with copper. The copper layer at the outer side of the tube has no real technical purpose. During the brazing process, the outer copper layer melts and the melted copper forms droplets on the outer tube wall leading to an unequal surface. Moreover, the outer copper layer reduces the heat transfer inside the tube when heat is applied by means of radiation or induction. The copper layer on the outer wall also imposes some manufacturing constraints such as the use of a black coating during the brazing process. As this black coating renders the brazing device dirty, a regular cleaning is required. When the tube is heated by applying a current to it by direct contact, the melted copper affects the electrical contacts at high temperature.

An object of the present invention is to provide a method for manufacturing a multiple walled tube that is less cumbersome to manufacture without affecting the quality of the manufactured tube.

For this purpose a method according to the invention is characterised in that said metal strip is plated on one side, the other side being formed by the steel of the metal strip and wherein said brazing is realised by brazing directly the plated side on the steel. By using a monoplated metal strip i.e. only plated at one side, the brazing is realised between the steel of the metal plate and the copper. As there is no longer copper on the outer tube wall, the copper can no longer form droplets on the outer side and thus not adversely affect the shape of the tube. The heat transfer towards the inner side of the tube is also improved, as the copper can no longer affect the thermal transfer. As the steel is on the outer side, there is no longer a problem of copper accumulation on the electric contacts during heating, if the latter is realised by means of direct electrical current. The method according to the present invention overcomes the technical prejudice that in order to manufacture a multiple walled tube, a double plated metal strip needs to be used. The skilled person would not even consider to use a monoplated metal strip, since the prior art teaches to use double plated and to solve brazing problems by using an additional layer such as tin or zinc which is superposed or forms an alloy with the copper layer. Surprisingly it has been found that if heat is applied by electromagnetic induction, the copper layer on the outer side acts as an electromagnetic shielding for the steel and restricts considerably the heat transfer to the interface between the walls, where the brazing should be applied. By using a monoplated metal strip, there is no longer a copper layer acting as an electromagnetic shielding. Consequently, the heat transfer is considerably improved. Further it has also been surprisingly observed that Eddy current testing of the tightness of the tube is improved when applied on tubes manufactured according to the present invention. It has indeed been observed that the testing current mainly flows through the copper skin of the tube, to the detrimental of the metal layer. If no such a copper layer is present, the Eddy current is equally distributed over the steel, enabling a reliable testing which leads to less erroneous test results and avoids unnecessary rejection of tubes.

A first preferred embodiment of a method according to the invention is characterised in that said metal strip is plated with copper, said copper being brazed to the steel of the strip. Copper being particularly suitable for brake-line tubes and being an appropriate material to braze.

Preferably, said brazing is realised by passing the formed tube through a radiation furnace.

Preferably said brazing is realised by applying an electric current by means of electrical contacts, contacting the steel surface. As already mentioned, the absence of copper on the outer side enables to avoid accumulation of copper on the electrical contacts.

Preferably said brazing is realised by inducing an electric current into said tube. As no copper is present on the outer wall, the copper no longer acts as an electromagnetic shielding.

The invention also relates to a method for plating a metal strip to be used for manufacturing a multiple walled tube, wherein a steel sheet is immersed in a first electrolytic bath and consequently in a second electrolytic bath, characterised in that the sheet is plated on both sides with a thin layer in the first bath, and plated on only one side in the second bath, the sheet being consequently immersed in a third electrolytic bath wherein the electrode has inverted polarity with respect to the one of the first and second bath. The inverted polarity enables to remove the copper layer applied in the first electrolytic bath on the side concerned, leaving one side with bare steel.

The invention will now be described in more details with reference to the drawings wherein.

Figure 1:
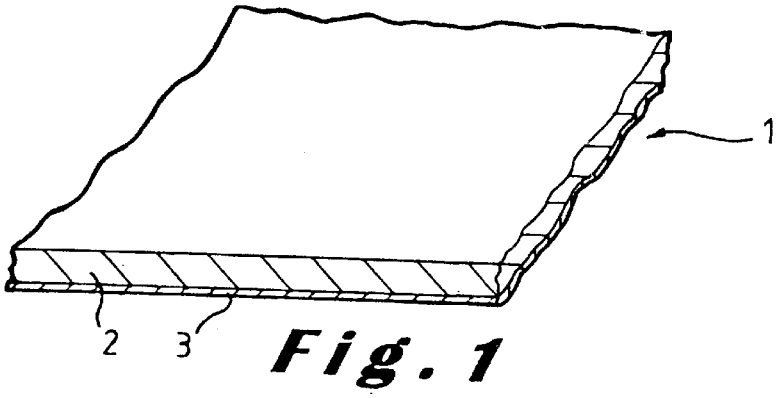
FIG. 1 shows a sectional view of a metal strip.

In the drawings, a same reference sign has been assigned to a same or analogous element.

FIG. 1 shows a sectional view of a plated metal strip 1. The strip is preferably made of metal such as steel or stainless steel. A copper layer 3 is applied on the steel 2 of the metal sheet in order to obtain a plated metal strip. A method for obtaining such a monoplated metal strip will be described in more details with reference to FIGS. 8 and 9. Instead of applying copper to plate the metal strip, other metals or metal alloys could be used such as zinc, tin or nickel. In the further description the example of copper will be used for the sake of clarity.

Figure 2:
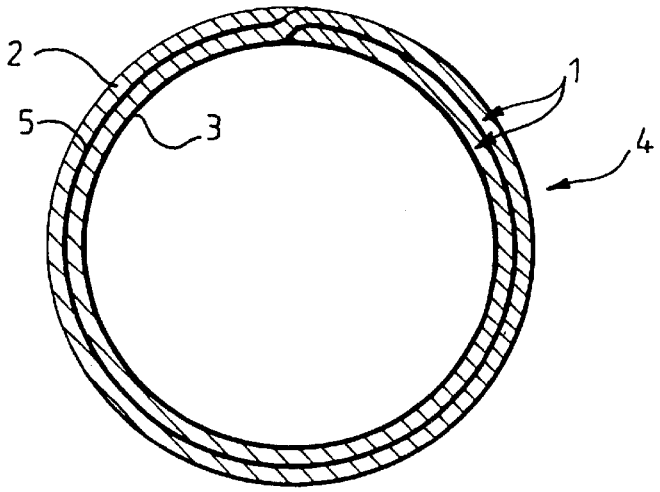
FIG. 2 shows a sectional view of a tube obtained by application of the method according to the invention.
Figure 3:
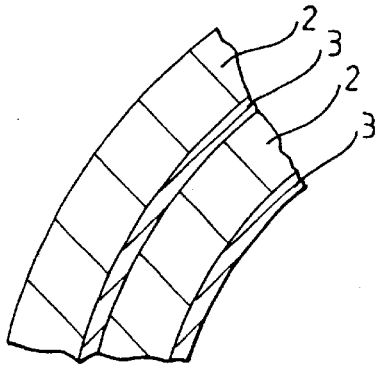
FIG. 3 shows at an enlarged scale a cross-section through the wall of the tube.

The plated metal strip 1 is used for manufacturing a multiple walled tube 4 such as illustrated in FIG. 2. Although FIG. 2 shows a double walled tube, it will be clear that the invention is not limited to a double walled tube. Such a double walled tube is obtained by rolling the plated metal through two complete revolutions. For obtaining an n-walled tube (n>2) n complete revolutions of the sheet are required. Upon rolling the tube, the copper layer 3 is situated at the inner side in order to form the inner tube wall. Consequently the steel side 2 forms the outer tube wall. This causes that at the interface 5 between two successive walls the copper layer 3 of an upper wall faces the steel side of the lower walls, as illustrated in FIG. 3.

In order to obtain a tight tube, it is necessary to heat the rolled strips forming the tube, in order to cause the surface of the tube walls, which are in contact with one another, to be brazed. By using the monoplated metal strip, the copper layer will be brazed directly to the steel. Brazing copper to metal such as steel, stainless steel or iron, overcomes the technical prejudices that brazing should be realised by copper with copper or copper with tin, nickel or zinc. Brazing a steel strip with copper on one side and bare steel on the other side has surprisingly proven remarkable performances. Experiments have proven an excellent bonding of the walls.

Traditionally, the brazing is realised by passing the formed tube through a radiation furnace, also called muffle tubes. According to the known method, a black coating, which mainly comprises bitumen, is applied on the external side of the tube in order to improve the heat transfer. The drawback of using this black coating is that it considerably pollutes the brazing device thus requiring a frequent cleaning thereof.

Experiments realised with the monoplated tube according to the invention, have surprisingly proven that the radiation heat transfer significantly improved. The absence of copper on the outer side of the tube has increased the heat transfer towards the brazing zone. The heat transfer was that efficient, that the black coating was no longer required, what considerably reduced the pollution of the device and provided a cleaner tube. As less cleaning was required, a higher productivity could be obtained and consequently a reduction of the productions costs.

Brazing can also be realised by using an induction coil for inducing electrical current into the tube. With this embodiment there is no direct contact between the tube and the inductive coil. By applying an electrical current to the induction coil, a magnetic field is created which on its turn, induces an electrical current into the tube. When the tube temperature is below the Curie point, the electrical current is concentrated at the skin of the tube. If a tube with copper on its outer side is used (conventional method) the current density is higher in the copper layer due to the better electrical conductivity of the copper with respect to the steel. Experiments have proven that the copper layer even acts as an electromagnetic shielding for the induced current and reduces the energy transfer in the steel.

Brazing could also be realised by applying directly an electric current to the tube, for example by means of electrical conductor, rolls or sliding pads. The current is fed through the direct contact between those rolls or pads and the tube and forced to flow into the tube which acts as an electrical resistance. The heat developed in such a manner in the tube will cause the copper to melt and braze with the steel. However, when according to the conventional method, there was also copper on the outer side, the latter copper also started to melt and got accumulated on the rolls or pads. Since according to the invention there is no longer copper on the outer side, that accumulation is avoided and power is saved as there is no longer power consumed to heat the copper on the outer layer. By having the steel surface on the outer side, the heating process is more reliable as the current flows through the steel towards the interface where the brazing is realised.

Figure 4:
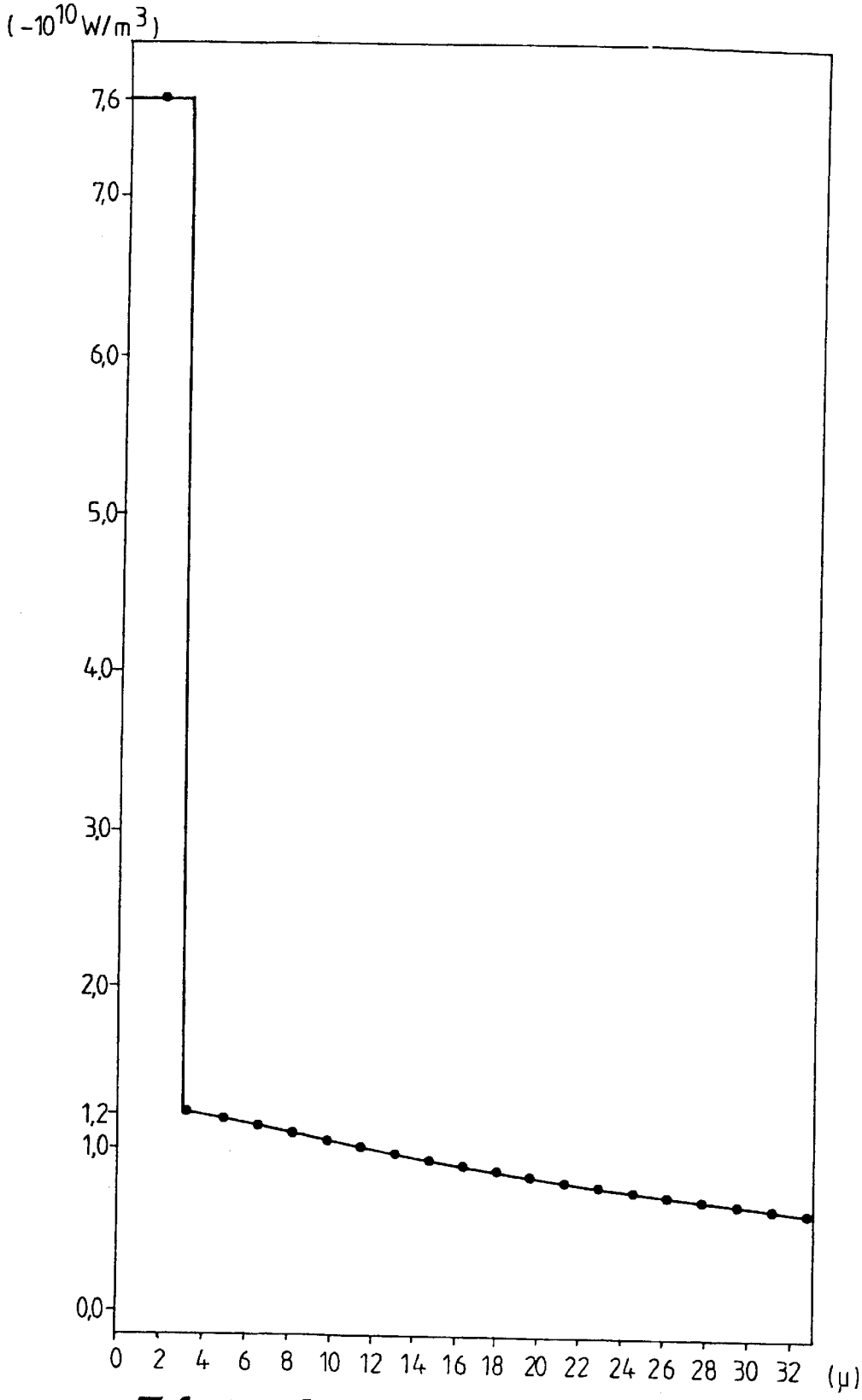
FIGS. 4, 5, 6 and 7 show curves illustrating the heating power as function of the wall thickness.

FIG. 4 illustrates the energy transfer as function of the wall thickness of the double plated tube. The horizontal axis represents the wall thickness of the tube in micron meters and the vertical axis the energy density in $10^{10}$ W/m$^3$. The origin being the external side of the tube and 700$\mu$ the internal side of a double walled tube. In this example, the measurements have been carried out on a tube where induction was used for brazing. As can be seen in this FIG. 4, for a density situated between 0 and 3$\mu$ the graph shows a peak in heating energy at the external copper coating. This signifies that a high amount of energy is required to heat up the external copper layer i.e. to cross the copper layer. When the steel level has been reached, the energy transfer is substantially reduced. The copper layer thus acts as a magnetic shielding for the steel and restricts consequently the heat transfer. Moreover, it results in the sublimation of some copper which deposits again on the cold parts of the induction coils.

Figure 5:
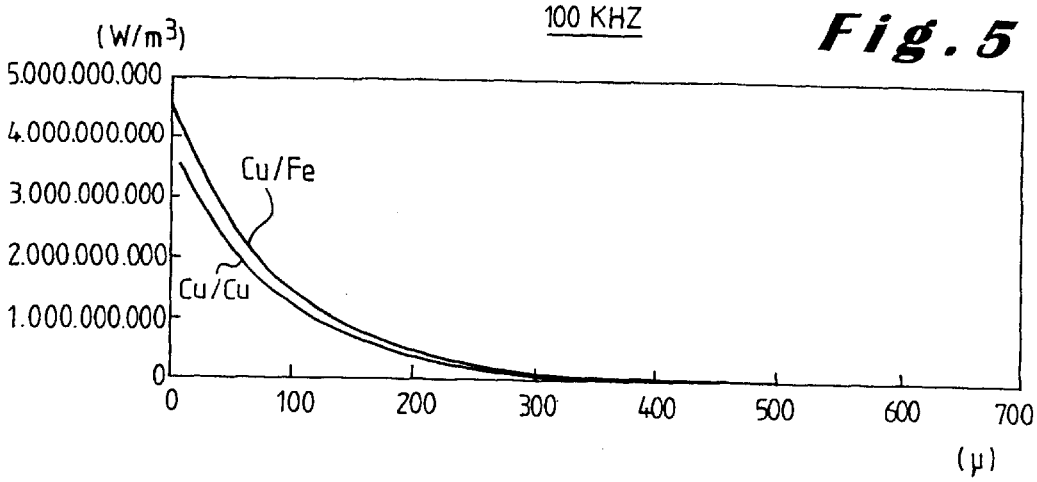
Figure 6:
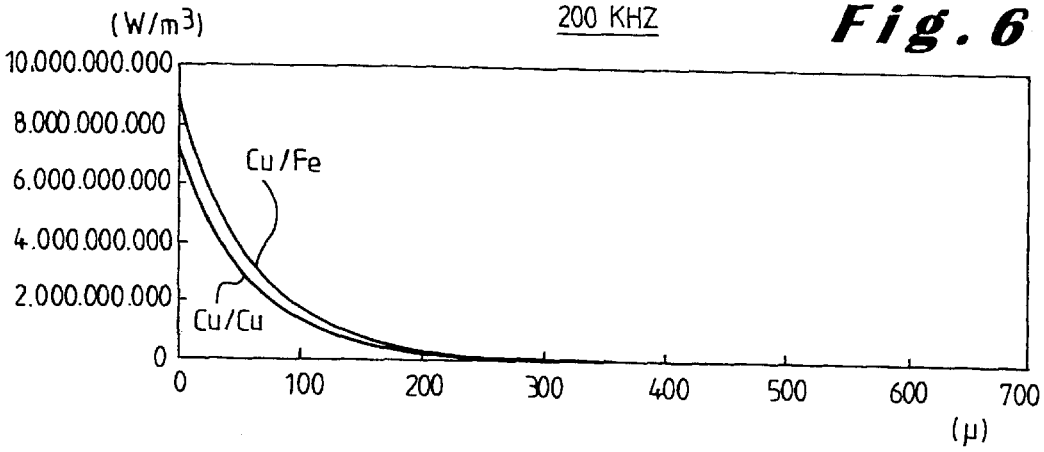
Figure 7:
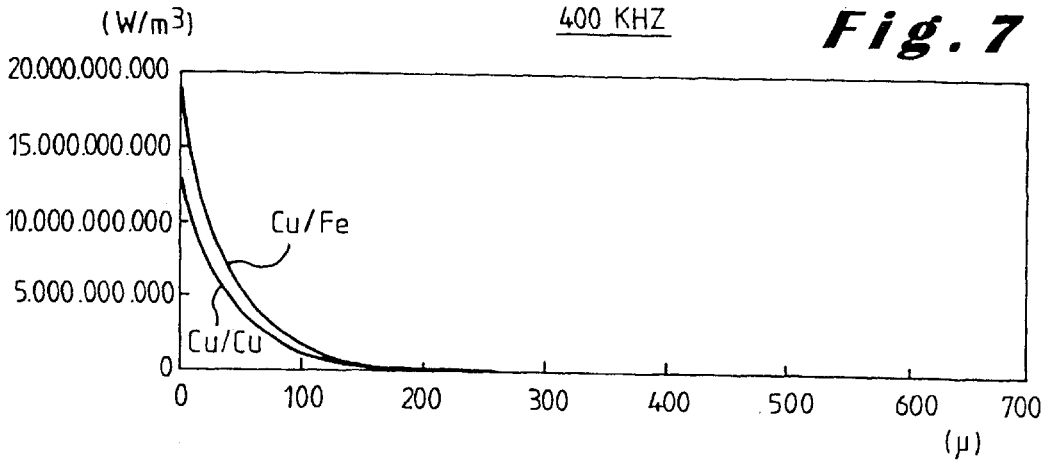

The FIGS. 5, 6 and 7 show curves where a comparison is made between monoplated steel tubes (Cu/Fe) and double plated steel tubes (Cu/Cu) using induction at 100 KHz, 200 KHz and 400 KHz respectively. As can be seen the peak due to the copper outer layer is not present for a monoplated steel tube. Moreover, the curve shows a continuous pattern over the whole thickness of the tube. The higher the frequency of the induction heating, the higher is the gap between the mono- and double plated tube at its outer skin.

A main application of a multiple walled tube being the brake lines for automotive. This application imposes a high quality standard on the tube i.e. without any hole, lack of brazing or pin-holes. The quality of the tube is controlled by using an Eddy current tester. This equipment is a non-destructive test, based on high frequency current induced into the tube. One coil induces the current and a second coil, placed downstream the first coil, picks up the induced current. The current in the first and second coil being compared with each other in order to detect a distortion between the two signals indicating a production failure.

The main difficulty to operate such an Eddy current tester in a reliable manner originates from the physics of the tooling. Indeed, by using high frequency to generate a test current into the tube, the law of physics implies that the test current mainly flows through the tube skin. When a double plated steel is used, the outside copper layer forms the main current path for the test current to the detriment of the rest of the material. Moreover, any deviation into the thickness of the copper layer increases the noise in the test signal. With the tube according to the present invention, where no copper is present on the outer layer, the test current is concentrated into the critical area of the tube to be tested. No noise was surprisingly recorded in the test signal enabling to increase the sensitivity of the test equipment.

Another advantage of the present invention is that the application of a sacrificial layer such as zinc, galfan or aluminium for enhancing the corrosion resistance, can be realised in an easier manner. When the sacrificial layer was applied on the copper layer, as it is the case according to the prior art, very detrimental electrochemical cells could be created between the iron, the copper and the sacrificial layer. Those cells were speeding up the dissolution of the sacrificial cell.

If the sacrificial layer was deposited with a hot dip process, it has been observed that the copper layer could not completely alloy with the sacrificial layer and that the copper migrated to the skin of the sacrificial layer by small chimneys. At the final stage, when an organic protection layer such as nylon was applied on the sacrificial layer, for example by extrusion or powder coating, those chimneys formed gas pockets creating a pressure on the organic layer which produced bubbles at the surface of the organic layer. The use of a monoplated strip avoids those problems since the outer copper layer of the tube is no longer present.

Moreover, using hot dip techniques with a tube having copper on its outer side, the copper is in direct contact with the melted metal for the sacrificial layer. This direct contact leads to a copper pollution of the coating material. By using a bare steel tube, the liquid metal is no longer polluted and neither will be the sacrificial layer.

Figure 8:
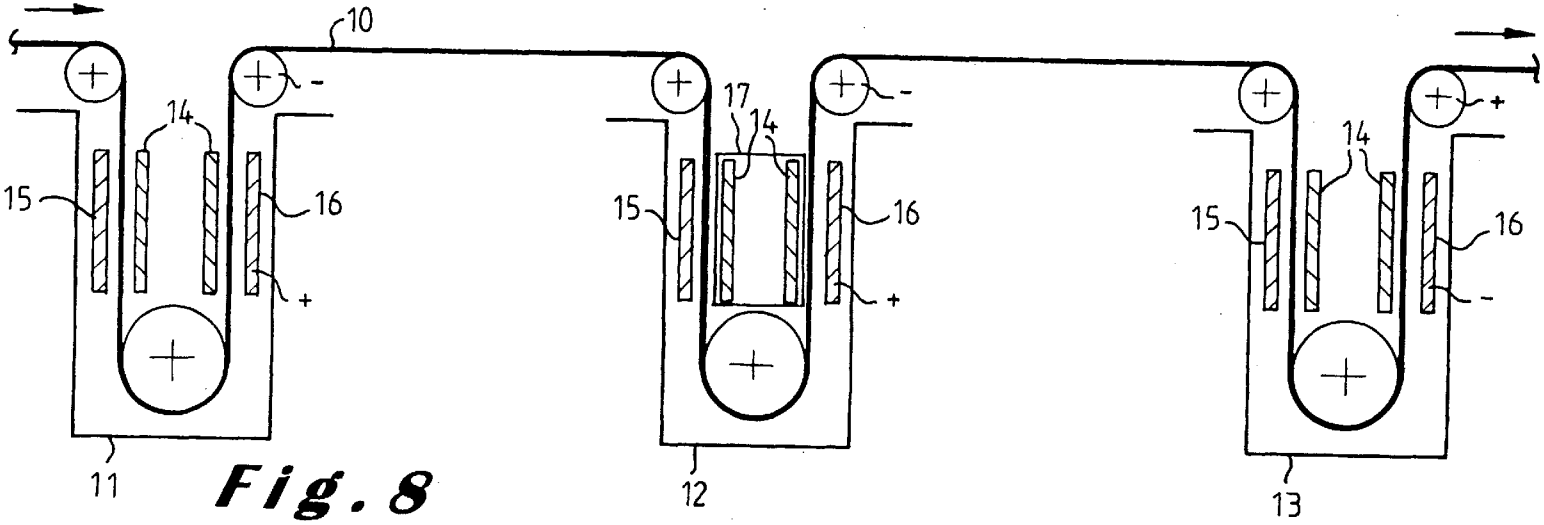
FIGS. 8 and 9 show a first and a second preferred embodiment of a method for manufacturing a monoplated metal strip.

FIG. 8 shows a first embodiment of a device enabling to produce a monoplated steel strip. The device comprises three successive electrolytic baths 11, 12 and 13 through which the metal strip 10 travels. The first bath 11 and the third bath 13 are preferably cyanide based baths, whereas the second bath 12 is an acid based bath. Instead of cyanide based baths, pyrophosphate baths could also be used. Each bath comprises a set of anodes 14, 15 and 16. The anodes 15 and 16 face one side of the strip whereas anode 14 faces the other side of the strip.

In the first 11 and second 12 bath a positive voltage is applied on the anodes once the strip 10 is grounded or at a negative voltage. The cyanide based electrolytic first bath 11 causes a thin copper layer of for example 0,2$\mu$ to apply on both sides of the strip. In the second bath 12 the anodes 14 are shielded in order not to apply a copper layer on the steel strip side facing those electrodes. The acid based bath causes a further copper layer of for example 3$\mu$ to be applied on the side, facing the electrodes 15 and 16.

In the third cyanide based bath 13, the polarity is inverted. Either a negative voltage is applied on the electrodes 14, or they are grounded whereas a positive voltage is applied on the strip. This inverted polarity causes the total removal of the copper layer facing the anodes 14 and of the thin film of for example 0,2$\mu$ of the side. In such a manner a monoplated strip is obtained.

Figure 9:
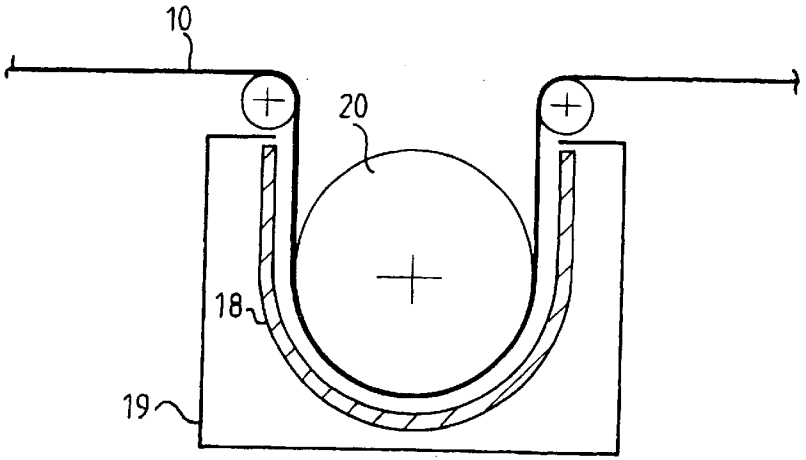

FIG. 9 shows another embodiment where the steel strip 10 is wound around a drum 17. An anode 18 is placed in a bath 19. As only one face is in contact with the bath, a monoplated steel strip is formed.

What is claimed is:

1. A method of manufacturing a multiple walled tube which method comprises:

a) plating a metal strip on only one side of the metal strip to form a plated layer; then b) rolling the plated metal strip through at least two revolutions to form a tube having at least a double wall with the plated layer being on the inside of the tube; then c) brazing the rolled tube immediately after the rolling step.

2. A method as claimed in claim 1, wherein said metal strip is plated with copper, said copper being brazed to a non-plated surface of the metal strip.

3. A method as claimed in claim 2, wherein the metal strip is made of a metal selected from the group consisting o stainless steel.

4. A method as claimed in claim 1, wherein said brazing is realized by passing the formed tube through a radiation furnace.

5. A method as claimed in claim 1, wherein said brazing is realized by inducing an electrical current into the formed tube.

6. A method as claimed in claim 1, wherein said brazing is realized by applying an electric current by means of electrical contacts contacting a non-plated surface of the formed tube.

7. A method of manufacturing a multiple walled tube which method comprises:

a) immersing a steel sheet in a first electrolytic bath to plate the sheet on a first side; then b) immersing the steel sheet in a second electrolytic bath to plate the other side of the sheet;

c) immersing the plated sheet in a third electrolytic bath, the electrode of the third electrolytic bath having inverted polarity with respect to the polarity of the first and second baths whereby the plating on one side of the metal sheet is removed leaving a plated layer on only one side of the metal sheet;

d) rolling the plated metal strip through at least two revolutions to form a tube having at least a double wall with the plated layer being on the inside of the tube; then e) brazing the rolled tube immediately after the rolled step.

8. A method as claimed in claim 7, wherein said first and third baths are cyanide based baths and said second bath is an acid based bath.

9. A method of manufacturing a multi-walled tube which method comprises:

a) immersing a steel strip in an electrolytic bath with only one face of the stip in contact with the bath so that only said face is plated to form a plated layer; then b) rolling the plated metal strip through at least two revolutions to form a tube having at least a double wall with the plated layer being on the inside of the tube; then c) brazing the rolled tube immediately after the rolling step.

10. A method of manufacturing a multiple walled tube which method comprises:

a) plating a metal strip on only one side of the metal strip to form a plated layer; then b) applying a sacrificial layer to the plated metal strip;

c) rolling the plated metal strip through at least two revolutions to form a tube having at least a double wall with the plated layer being on the inside of the tube; then d) brazing the rolled tube immediately after the rolling step.

11. A method as claimed in claim 10 wherein the sacrificial layer is selected from the group consisting of zinc, galfan and aluminum.

12. A method as claimed in claim 10 wherein the step of applying a sacrificial layer is performed by a hot dip process.

13. A method as claimed in claim 10 further comprising the step of applying an organic protection layer on the sacrificial layer.

* * * * *